US005393269A

United States Patent [19]

Atkinson, Jr.

[11] Patent Number: 5,393,269

[45] Date of Patent: Feb. 28, 1995

[54] BOWLING PIN SETTING MECHANISM AND SCISSOR ARMS

[76] Inventor: William A. Atkinson, Jr., 1799 Bodwell Rd., Unit 1, Manchester, N.H. 03109

[21] Appl. No.: 180,570

[22] Filed: Jan. 12, 1994

[51] Int. Cl.[6] ..... A63D 5/08

[52] U.S. Cl. ..... 473/73; 473/57; 473/86; 473/87; 473/65

[58] Field of Search ..... 473/57, 65, 73, 86, 473/87, 88, 100

[56] References Cited

U.S. PATENT DOCUMENTS

| | | | |
|---|---|---|---|
| 2,616,750 | 11/1952 | Montooth . | |
| 2,729,449 | 1/1956 | Montooth . | |
| 2,817,527 | 12/1957 | Montooth . | |
| 2,817,528 | 12/1957 | Sanford . | |
| 2,915,313 | 12/1959 | Montooth . | |
| 2,949,300 | 8/1960 | Huck et al. . | |
| 2,967,708 | 1/1961 | Huck et al. . | |
| 3,138,378 | 6/1964 | Krollman | 473/57 |
| 3,219,345 | 11/1965 | Rogers | 473/57 |
| 3,265,390 | 8/1966 | Stauth | 473/57 |
| 3,314,678 | 4/1967 | Conklin et al. | 473/57 |

*Primary Examiner*—Mark S. Graham
*Assistant Examiner*—William M. Pierce
*Attorney, Agent, or Firm*—Davis, Bujold & Streck

[57] ABSTRACT

This invention relates to a modification of existing bowling alley pin setting equipment to facilitate bowling practice. The fixed pivot point of the scissor arms, supported by the scissors deck, is movable from a first position, in which the original pivot point of the scissors arms is maintained, to a second position, in which the pivot point is movable to prevent adequate closing of the scissor arms whereby an undesired pin(s) is not clamped by the scissor arms and remains on the bowling surface where it may be swept away by the sweeper during its sweeping motion. All of the necessary pin(s), required for a desired bowling practice pin combination, a clamped and raised by the scissor arms during the resetting cycle. The invention also relates to a control mechanism for controlling movement of the slidable pivot point.

16 Claims, 9 Drawing Sheets

FIG. 8A
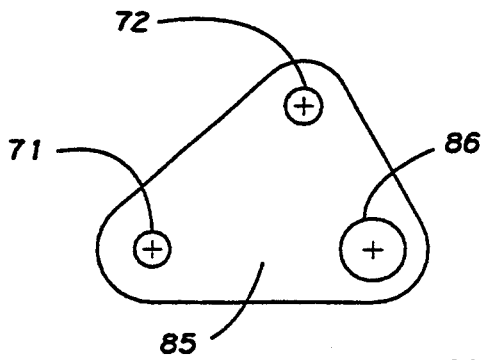
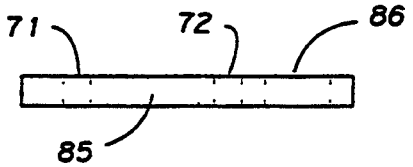
FIG. 8B
FIG. 7A
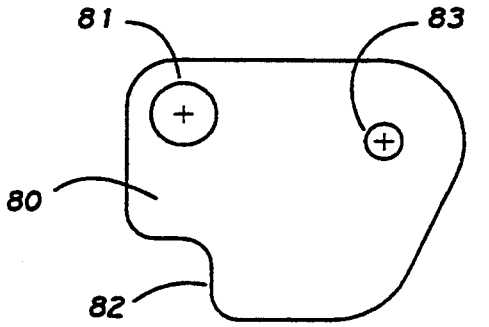
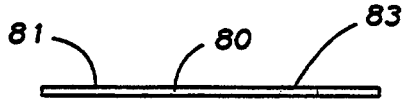
FIG. 7B
FIG. 6A
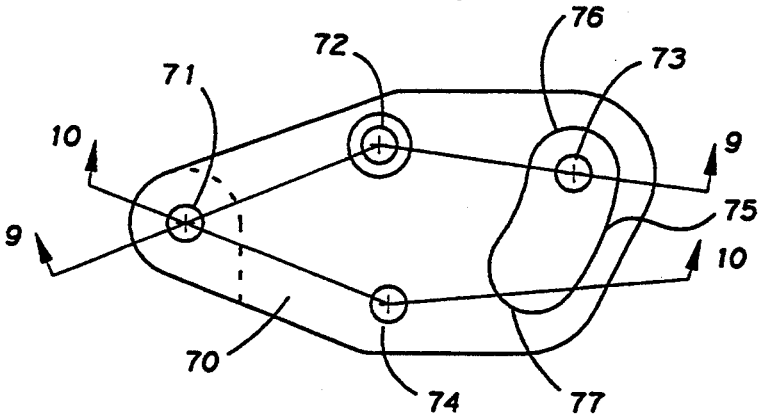
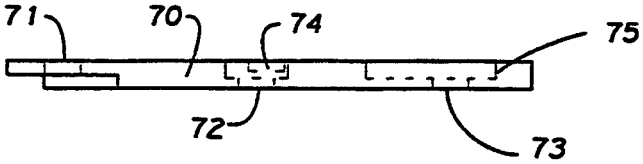
FIG. 6B FIG. 11
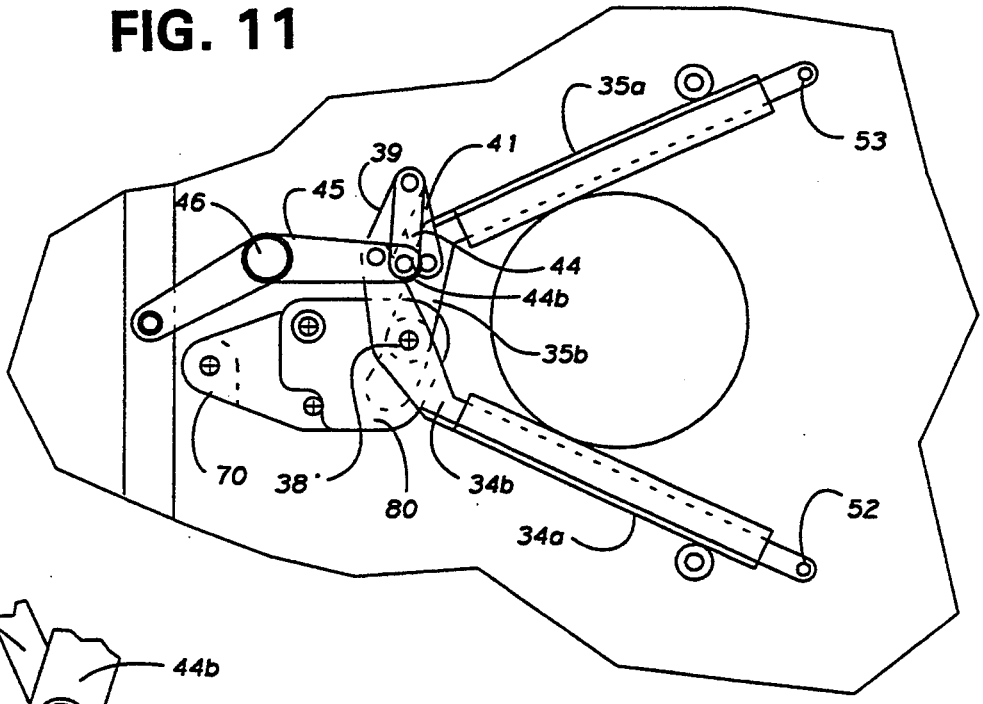
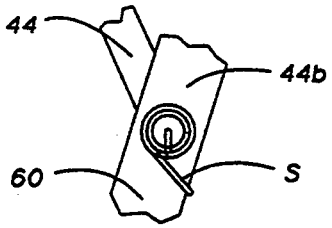
FIG. 15
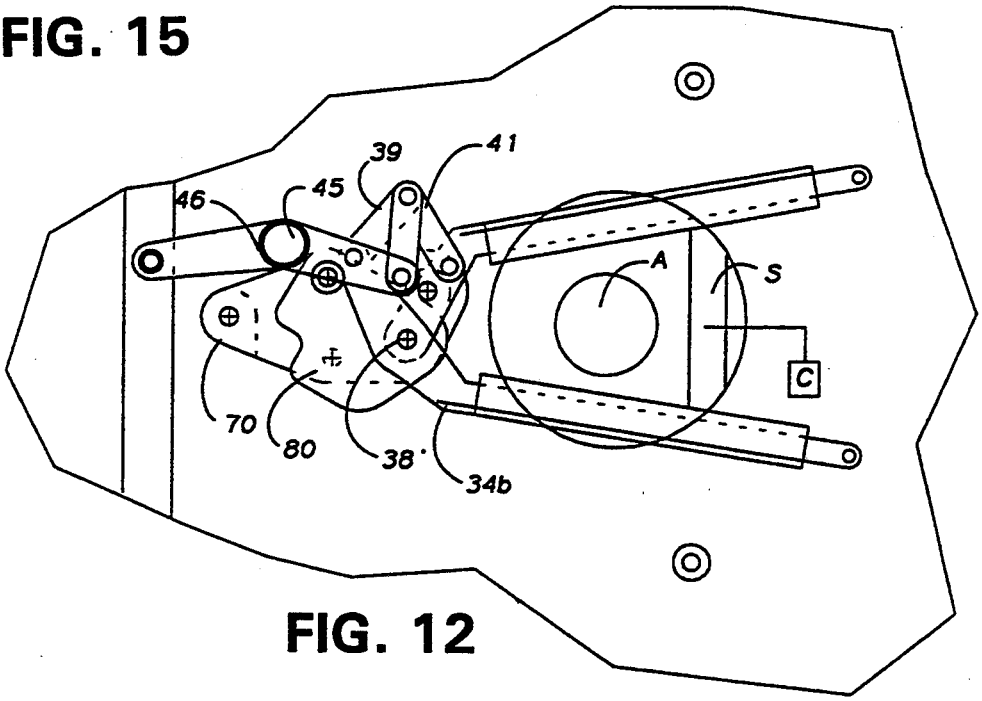
FIG. 12

BOWLING PIN SETTING MECHANISM AND SCISSOR ARMS

The present invention relates to an improvement in a bowling pin setting mechanism which allows the bowler to select which of the ten bowling pins the bowler wants to remain on the bowling surface after resetting of the pins to facilitate bowling practice, e.g. 4-10 split.

BACKGROUND OF THE INVENTION

In the prior art embodiment illustrated, a generally triangular deck structure, indicated generally at 1, has a main intermediate deck 2 having upstanding rods at opposite sides thereof, one of these rods being indicated at 3, which connect the deck structure to movable mechanism (not shown) for obtaining up and down movement of the deck structure.

The intermediate deck 2 has a forward upstanding bracket 4 and a pair of upstanding brackets located at the rear corners thereof, one of them being indicated at 5, to support a generally triangular moving deck 6 for forward and rearward movement parallel to the intermediate deck 2 by means of links 7 and 8 pivoted to the brackets 4 and 5 and moving deck 6.

The intermediate deck 2 carries fixed setting shoes 10 which cooperate with movable setting shoes 11 which may be grooved at the lower end to receive the lower end of a fixed shoe 10. A pair of shoes 10 and 11 are associated with each other and ten pairs are arranged similarly to the arrangement of pins on an alley bed. The shoes 11 are mounted on the moving deck 6 to form with the fixed shoes 10 openings for receiving pins from a magazine (not shown) disposed above the deck structure and for subsequently setting pins on the alley bed. When the moving deck is in its forward position, the shoes 10 and 11 will be closely adjacent each other and when it is desired to receive pins therebetween, the moving deck 6 will be moved rearwardly to form an opening between the pairs of shoes 10 and 11 of a size to receive and hold a pin and a pin may be then positioned therebetween. When it is desired to set pins, the deck 1 is placed adjacent the alley and the shoes are opened further apart to release the pins.

Also carried on the underside of the moving deck 6 are a plurality of pressure pads arranged similarly to the spots on the alley bed which may be formed of resilient material, one of these pressure pads being designated at 12. These pads function to engage the tops of standing bowling pins A when the deck 1 is in its pin pickup position. When the setting shoes 10 and 11 move apart to receive a pin, the pressure pads 12 will be moved rearwardly and out of vertical alignment with the pin spots on the alley bed.

The intermediate deck 2 has a generally triangular scissors deck 30 suspended there beneath by rods 31 which is provided with ten openings 33 arranged similarly to the spot arrangement on an alley bed, as shown in FIG. 2.

A pair of scissor arms of what may be generally termed a scissors-type is associated with each of these openings 33. The corresponding arm in each pair is alike and the corresponding arms are designated at 34 and 35, respectively. The description and operation of these arms may be more clearly understood by reference to FIGS. 3 to 5 of the drawings. The detailed description of one pair of arms 34, 35 and actuating mechanism is believed sufficient since the actuating mechanism is also the same for substantially all pairs of arms. Each of the arms 34 and 35 has an elongated pin-engaging portion **34*a*, 35*a* receiving a piece of resilient material fastened thereto, indicated at 36 and 37, respectively, and each arm has a mounting portion 34*b*, 35*b* extending at an angle to the pin engaging portions 34*a* and 35*a***.

The mounting portion **34*b* of arm 34 is pivoted intermediate its ends to a fixed pin 38', defining an axis extending upwardly from and secured to the scissors deck, and the mounting portion 35*b* of arm 35 is pivoted at one of its ends to this pin 38'. One end of portion 34*b* of the arm 34 has a link 39 pivoted thereto at one of its ends by a pin 40, and the mounting portion 35*b* of arm 35 has one end of a link 41 pivoted thereto by a pin 42 a short distance from its end mounted on the fixed pin 38'. The links 39 and 41 are pivotally connected together at their other ends, by a pin 43. A drag link 44 disposed above toggle links 39 and 41 is pivotally connected at one end 44*a* to the pivot pin 43 which pivotally connects the links 39 and 41 and at its other end 44*b* to an operating arm 45 by a pin 46. The operating arm 45 is pivotally mounted on the scissors deck 30 by a pin 46*a* secured to the scissors deck and has an arm 47 forming therewith a bell crank, the other end of the arm 47 being pivotally connected to an actuating rod 48 by a pin 49**.

A pair of stops 50 and 51 upstanding from the scissors deck 30 are provided for limiting the opening movement of the scissor arms 34 and 35, respectively. The outer ends of the arms 34 and 35 may be provided with buttons 52 and 53 of low frictional properties to slidably support the outer ends of the arms on the scissors deck 30.

The scissor arms are normally urged to a pin pickup position wherein they extend generally parallel by a spring 55 which acts through a bell crank having arms 56 and 57 to shift a link 58 to cause movement of one of the bell crank arms 47, as shown in FIG. 2.

The series of bell crank arms 47 extending across the rear of the deck structure are interconnected by the actuating rod 48 which extends across the rear of the deck structure and actuates the scissor arms 34 and 35 for the 7, 8, 9 and 10 pins.

The scissor arms for the 1, 2, and 4 pins are operated by an actuating rod 60 which is connected to the inner end of the arm 45 associated with the pickup mechanism for the 7 pin and is pivotally connected at its forward end to an arm 61 pivotally mounted on the scissors deck 30. Similar actuating rods 62 and 63 are provided for actuating the pin pickup apparatus associated with the 3 and 5 pins and with the 6 pin. The forward ends of these rods are supported by arms 64 and 65 pivotally mounted on the scissor deck.

The movement of the scissor arms 34 and 35 under the urging of the spring 55 is controlled by a cable 66 which extends around a groove in a pulley 67 mounted on the intermediate deck frame 2 and upward to a cam follower diagrammatically designated by 121 in FIG. 2 which may move in response to highs and lows on a rotatable cam in the control mechanism. The lower end of the cable 66 is fastened around an arm 68 which is fixed for rotation with the arms 56 and 57 so that as cable 66 is paid out under cam control when the deck structure is in a pin pickup position, the spring 55 becomes operative to move the scissor arms 34 and 35 in each pair toward each other. As the cable is taken in, the spring is tensioned and the pairs of scissor arms 34 and 35 are moved away from each other.

The withdrawn position of the scissor arms 34 and 35 is shown in FIGS. 2 and 3. The pin pickup position of the arms is shown in FIGS. 4 and 5 where the arms have contacted pins in different off-spot positions.

In FIG. 4, the position of the arms illustrated is that where a pin which is on-spot would be picked up since the pin is only off-set in a direction which is in line with the pivot point 38 for the arms 34 and 35 and the on-spot position for a pin. In the position of FIG. 4, the arm 45 has caused movement of the drag link 44 to place the end 44*b* of the drag link over the pivot pin 38' for the pickup arms 34, 35 and move the links 39 and 41 into a straight-line position to make the toggle to scissor the arms to pin engaging position. The pin will be engaged at any point along the length of the scissor arms.

In FIG. 5, movement of the arm 45 has caused movement of the drag link 44 and because of the off-spot condition of the pin, the arm 35 has traveled only a short distance until it engages a pin which prevents further movement of the arm 35. Continued movement of the drag link will carry the link 39 to produce continued movement of the arm 34 as well as causing pivoting of the link 41 about its pivot 42 until the end 44*b* of the drag link is over the pivot pin 38 for the scissor arms and the arm 34 engages the pin and the toggle is made.

The drag link 44 is utilized to apply a force to the toggle links at their point of pivotal connection together. For this purpose the drag link may be considered a floating force applying member in that it need not occupy any particular position nor exert a force along any particular line in order to operate the mechanism. Thus it will be seen that in FIG. 4 the drag link 44 is in approximately the "seven o'clock" position while in FIG. 5 it is in a "five o'clock" position. The important feature is that a force applying member such as the drag link 44 be provided to make and break the toggle which is not constrained to movement or operation along any prescribed or predetermined path, in other words that it be "floating."

It will be seen that the entire assembly is centered about the rotational axis of pin 38' of the scissors arms and no force is exerted which can move the assembly from the position which it occupies. The pin will be held engaged by the pair of scissor arms until the deck has ascended to permit sweeping and the deck has again descended to place the pins again on the alley bed. The cable 66 will then be taken in to tension the spring 55 and reverse the movement of the drag links 44 to break the toggles and move the scissor arms 34 and 35 to their withdrawn position.

It will be seen from the foregoing that scissors-type pin pickup mechanism has been provided, all of which are simultaneously mechanically operated by a control mechanism at a remote source and without the movement in a vertical direction of pressure plates or other members which are contacted by pins as the deck descends to its pin pickup position. The foregoing description describes an existing prior art bowling alley assembly which forms no part of the present invention.

The present invention is directed to modifying an existing pin setting mechanism so that the scissor arms can be effectively deactivated so that it does not sufficiently clamp a bowling pin located therebetween during the resetting cycle thereby allowing the bowling pin to remain on the bowling surface and be swept away by the sweeper during its sweeping motion. By selective deactivation of any number of the ten scissor arms, any number of the ten bowling pins can be selectively chosen to remain on the bowling alley, after a resetting cycle, so that a bowler may practice knocking down any desired combination of pins.

SUMMARY OF THE INVENTION

The present invention relates to a pin setting apparatus comprising a scissors deck having ten pin openings provided therein with a pair of scissor arms being located adjacent each of the ten pin openings, each said pair of scissor arms having a pivot axis located adjacent one of the ten pin openings and said scissor arms being movable over at least a portion of a said adjacent pin opening, a sweeper for sweeping the bowling surface, and a mechanism for controlling said scissors deck, said scissor arms and said sweeper for resetting bowling pins, the improvement wherein at least one of said pair of scissor arms has a pivot axis which is movable from a first position, in which said scissor arms are positioned to clamp and raise a said pin located therebetween during a resetting cycle, to a second position in which said scissor arms insufficiently close during the resetting cycle whereby a said pin located therebetween is not clamped and raised by said scissor arms and may be swept away by said sweeper.

The present invention also relates to a method of modifying a pin setting apparatus comprising a scissors deck having ten pin openings provided therein with a pair of scissor arms being located adjacent each of the ten pin openings, each said pair of scissor arms having a fixed pivot axis located adjacent one of the ten pin openings and said scissor arms being movable over at least a portion of a said adjacent pin opening, a sweeper for sweeping the bowling surface, and a mechanism for controlling said scissors deck, said scissor arms and said sweeper for resetting bowling pins, said method comprising the steps of:

removing said fixed pivot for each said scissor arms, and replacing said fixed pivot with a movable pivot having a first position in which said scissor arms are positioned to clamp and raise a said pin located therebetween during a resetting cycle, and a second position in which said scissor arms insufficiently close during the resetting cycle whereby a said pin located therebetween is not clamped and raised by said scissor arms.

BRIEF DESCRIPTION OF THE DRAWINGS

The objects of the invention generally set forth, together with other ancillary advantages, are attained by the construction and arrangement shown, by way of illustration, in the accompanying drawings, in which:

FIG. 6A is a top plan view of a base member of the present invention;

FIG. 6B is a front elevational view of the base member of FIG. 6A;

FIG. 7A is a top plan view of an intermediate member of the present invention;

FIG. 7B is a front elevational view of the intermediate member of FIG. 7A;

FIG. 8A is a top plan view of a top member of the present invention;

FIG. 8B is a front elevational view of the top member of FIG. 8A;

FIG. 11 is a diagrammatic top plan view of a pin pickup mechanism incorporating the movable pivot mechanism of the present invention with the top plate removed for explanation purposes;

FIG. 12 is a diagrammatic plan view of the pin pickup mechanism, according to the present invention, with the top plate removed for explanation purposes, showing movement of the pivot whereby the scissors arms insufficiently close thereby not picking up a bowling pin;

FIG. 15 is a partial diagrammatic view showing a spring for initiated movement of the one of the two scissor arms.

DESCRIPTION OF THE PREFERRED EMBODIMENT

Figure 1:
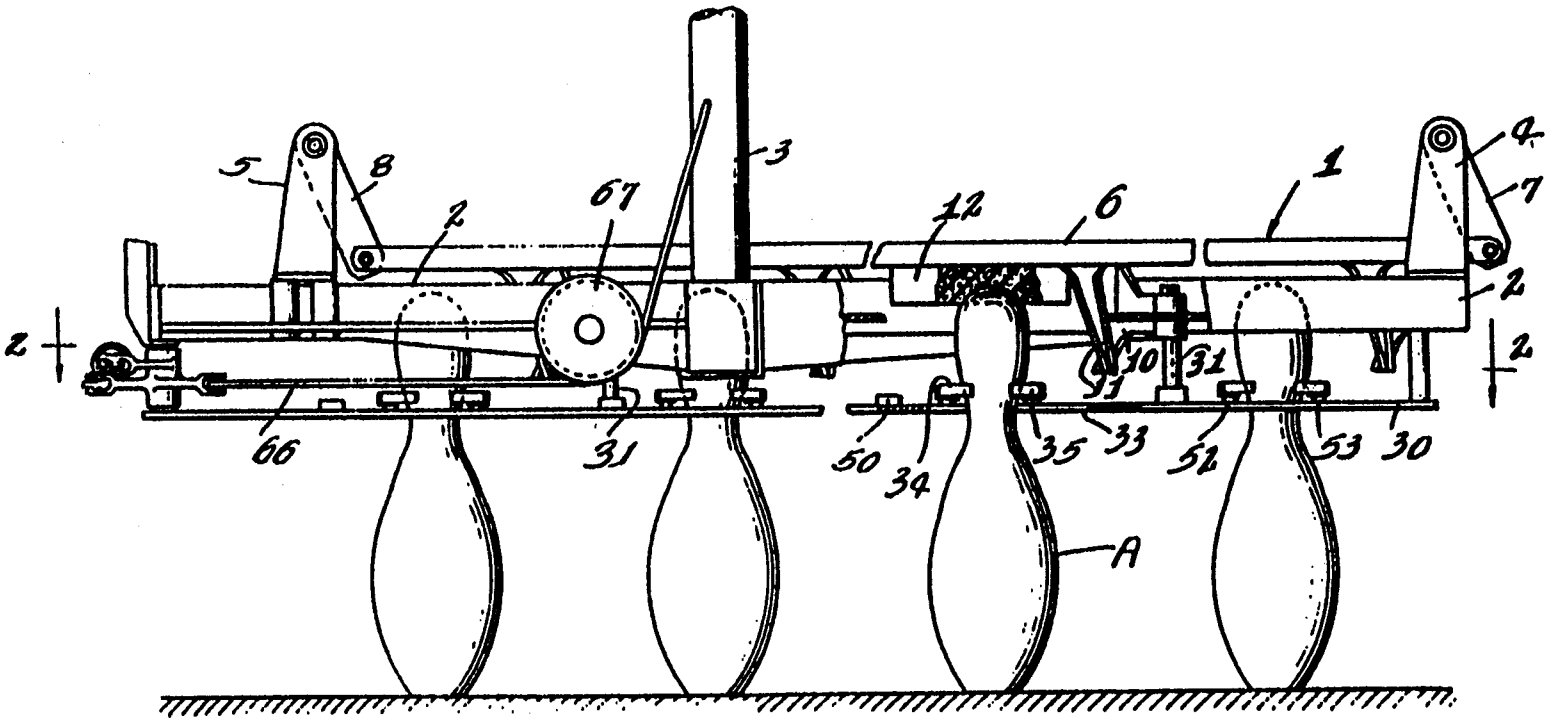
FIG. 1 PRIOR ART
FIG. 1 is a side elevational view of a prior art bowling pinsetter deck structure partly in section showing the deck structure in a pin pickup position with parts in section.

With reference to FIGS. 6–11, the movable pivot mechanism of the present invention will now be discussed in detail. The movable pivot mechanism 89 comprises a base member 70, an intermediate slide member 80 and a top member 85.

The base member 70 (FIGS. 6A and 6B) is provided with first and second mounting holes 71, 72 for securing the base of the movable pivot mechanism to the scissors deck. An arcuate shaped slot 75, containing a bore 73, is also provided in the base member 70 adjacent one end thereof. The arcuate shaped recess or slot 75 has first and second opposed slot ends 76, 77 and extends at least partially through the base member 70. A cavity 74, which is sufficiently deep to accommodate an armature 88 of a solenoid 87, is also provided in the base member 70.

The top member 85 (FIGS. 8A and 8B) is provided with corresponding first and second mounting holes 71, 72. The top member 85 is also provided with a threaded solenoid bore 86 for mounting the solenoid 87 to the top member 85.

The intermediate slide member 80 (FIGS. 7A and 7B) is provided with a pivot bore 81 which is aligned with the second mounting hole 72 of the base member 70. A T-nut bore 83 is provided for mounting a large T-nut 84, supporting a pair of pick-up scissor arms 34 and 35, to a top (first) surface of the slide member 80. An abutment surface 82 is formed along a side surface of the slide member 80 at a location remote from the T-nut bore 83.

When the abutment surface 82 abuts against the extended armature 88, such abutment prevents the slide member from pivoting, about the pivot bore 81, and maintains the slide member in its first position, i.e. the pivot of the scissor arms 34, 35 is fixed in its originally intended position. Alternatively, when the armature 88 is activated and retracted within the solenoid 87, the abutment surface 82 no longer abuts against the armature 88 and the slide member 80 is thus free to pivot about the pivot bore 81 to its second position. A further description concerning such activation of the armature will follow hereinafter. Such movement moves the pivot axis 38 (FIG. 10) of the scissor arms 34, 35 to a second position in which the scissor arms 34, 35 are prevented from adequately closing and engaging a desired bowling pin A (FIG. 12), during their closing motion, and a further explanation concerning the second position of the slide member 80 and the pivot axis 38 will follow hereinafter.

Figure 10:
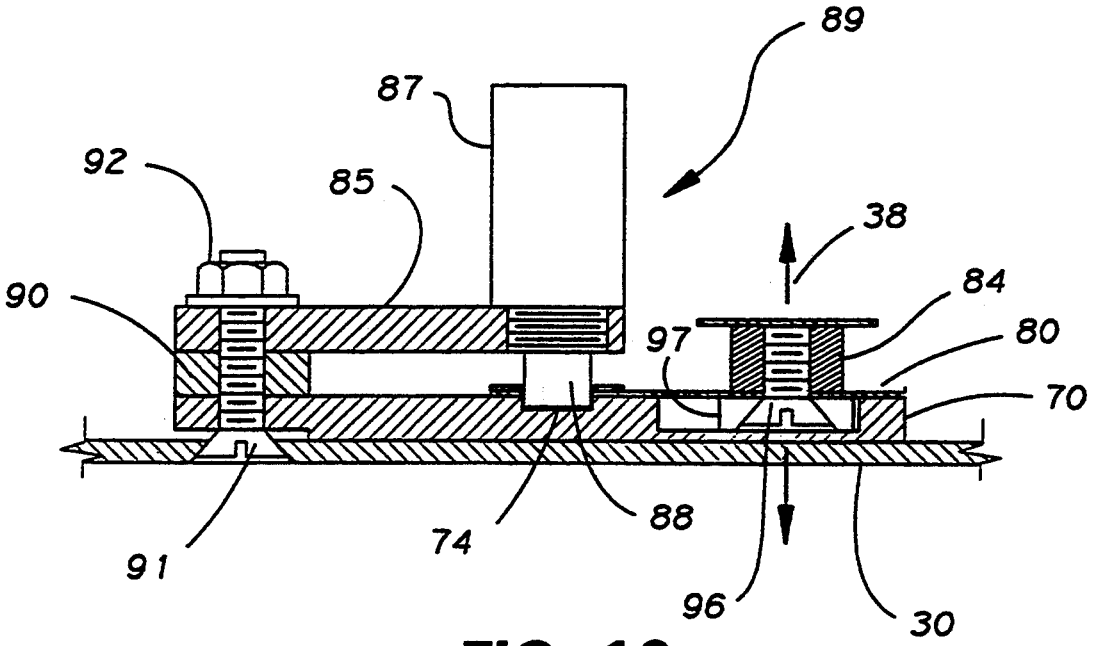
FIG. 10 is a diagrammatic cross sectional view of the assembled movable pivot mechanism generally along line 10—10 of FIG. 6A.
Figure 9:
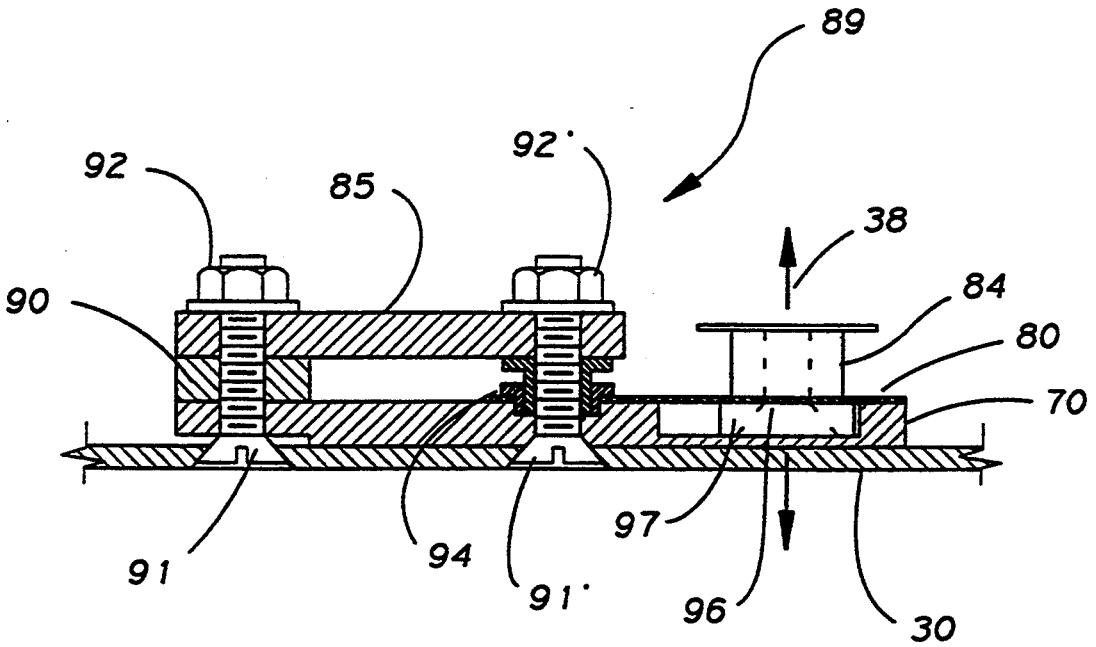
FIG. 9 is a diagrammatic cross sectional view of the assembled movable pivot mechanism generally along line 9—9 of FIG. 6A.

Turning now to FIGS. 9 and 10, assembly of the movable pivot mechanism 89 will now be described. The present design of the movable pivot mechanism 89 is directed at resulting in only minor modifications of the existing scissors deck 30 of the prior art bowling alley equipment. Accordingly, the base member 70 has a distance of 3" from mounting hole 71 to hole 73 so that the holes already contained on the scissors deck 30 may be utilized. It is to be appreciated, however, that the movable pivot mechanism 89 could have many shapes and/or constructions as long as it provides movement of the pivot axis 38 from a first position to a second position.

Prior to mounting the movable pivot mechanism 89 to the scissors deck 30 adjacent one of the ten pin openings, it is first necessary to drill four holes H' in the scissors deck adjacent the 7, 8, 9 and 10 pin openings and ten additional holes H (FIGS. 2 and 3), one adjacent each of the ten pin openings, i.e. a hole in the scissors deck for a bolt to be inserted through the second mounting holes 72. Thereafter, all ten of the pins 38' and the stops 51 for the 2, 4, 5, 7, 8 and 9 pin openings are removed and a first bolt 91 is inserted from underneath the scissors deck through the hole of the stop 51 and the first mounting hole 71 of the base member 70. For the 7, 8, 9 and 10 pin openings, the first bolt 91 is inserted from underneath the scissors deck through the associated hole H' and the first mounting hole 71 of the base member 70. This screw also passes through a spacer 90 and the first mounting hole 71 in the top member 85. Finally, a nut 92 engages the opposite end of the first bolt 91 to tightly secure those components together.

A cylindrical stop collar 97 is mounted to the bottom second surface of the slide member 80, via a mounting screw 96, while the opposite end of mounting screw 96 is threaded into the large T-nut 84 supporting the pick-up arms 34 and 35. For simplification, the pick-up arms 34 and 35 are not shown in FIGS. 9 and 10.

A second bolt 91' passes through one of the ten newly drilled holes H in the scissors deck, the second mounting hole 72 of the base member 70, an oilite bushing 94, the pivot bore 81 of the slide member 80, a second smaller T-nut 93, and the second mounting hole 72 of the top member 85. The oilite bushing 94 and the second smaller T-nut 93 are accommodated within the pivot bore 81 of the slide member 80. A second nut 92' engages the opposite end of the second bolt 91' to tightly secure those components together.

A solenoid 87, for example Part No. 2A174 manufactured by Dormeyer Industries, is threaded into solenoid bore 86 (FIG. 10) and the intermediate member 80 is moved to its first position such that the armature 88 can extend into the cavity 74 and prevent the slide member 80 from pivoting to its second position. A further description concerning electrical wiring of the solenoid 87 will follow hereinafter.

Figure 4:
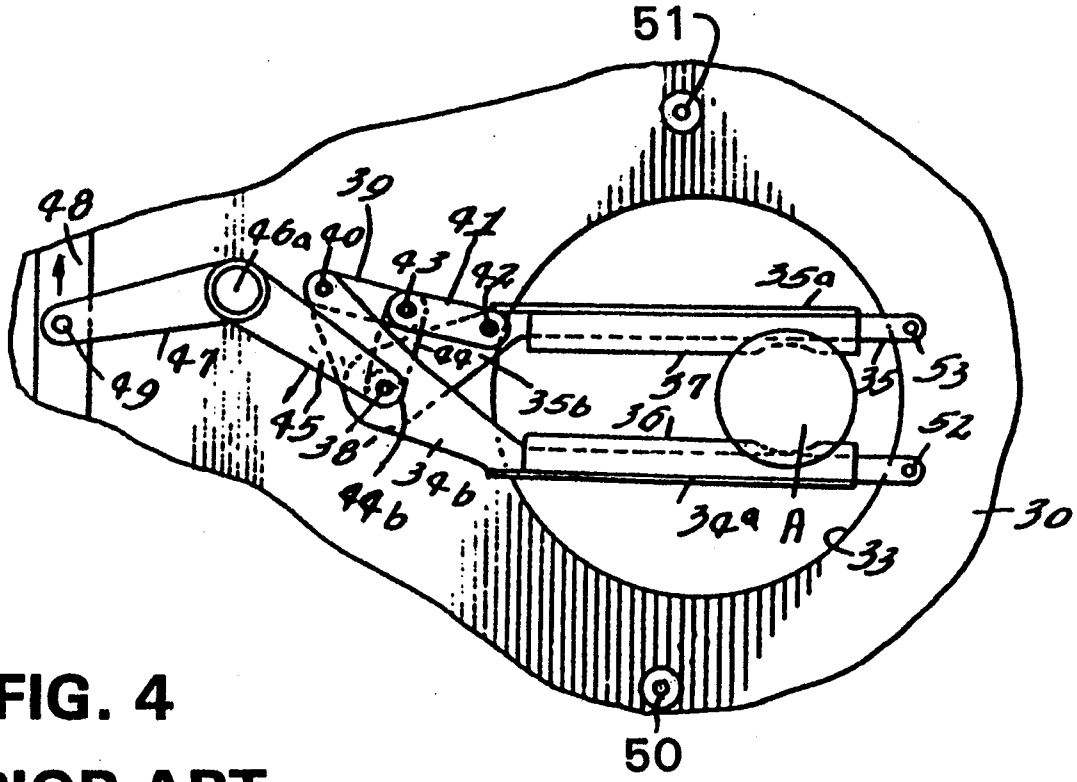
FIG. 4 PRIOR ART
FIG. 4 is a plan view similar to FIG. 3 but showing the scissor arms in position to pickup an off-spot pin.
Figure 5:
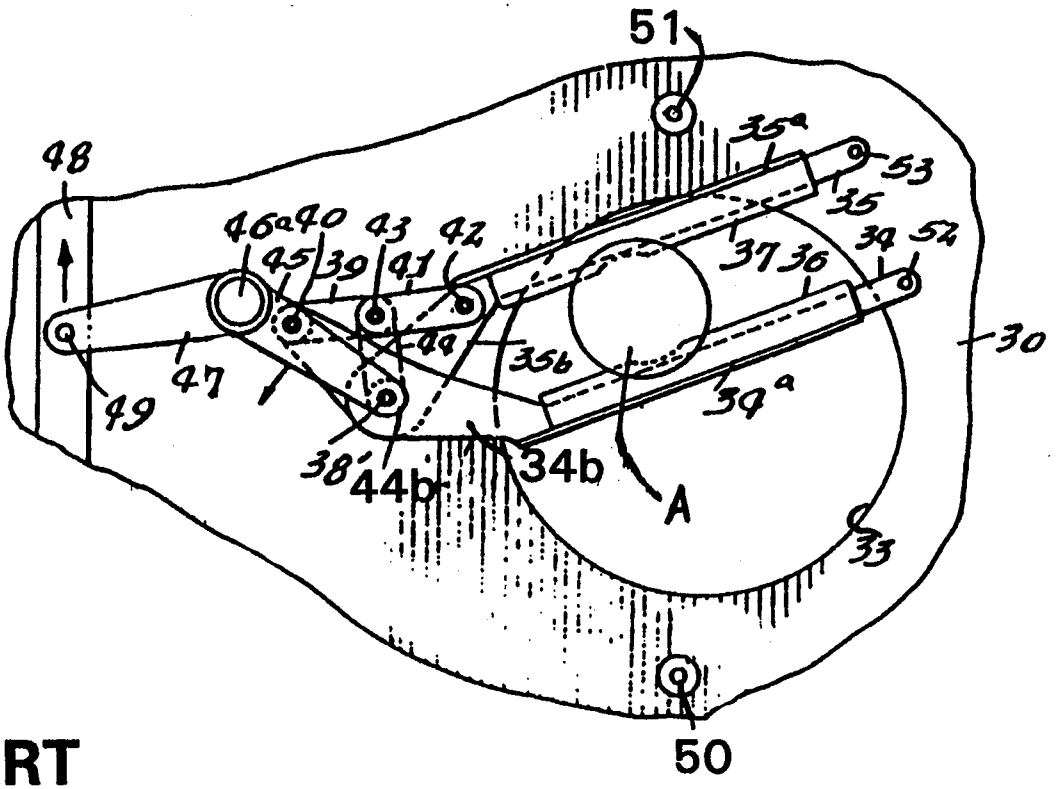
FIG. 5 PRIOR ART
FIG. 5 is a plan view similar to FIG. 3 showing the scissor arms in position to pickup a pin in an off-spot position different from that in FIG. 4.

When the solenoid 87 is energized, the armature 88 is retracted within the solenoid 87 and the abutment surface 82 can no longer abut against the armature 88 thereby freeing the slide member 80 so that it may pivot to its second position. The slide member 80 pivots about pivot bore 81 until the stop collar 97 abuts against the second end 77 of the slot 75 and thereby prevents further pivoting movement. In this position, the pivot axis 38 (large T-nut 84) is moved away from the operating arm 45 so that when the operating arm 45 rotates clockwise to close the scissor arms 34, 35, the toggle links 39 and 41 never become aligned with one another and perpendicular with respect to the dragged link 44 as in FIGS. 4 and 5, i.e. the toggle links 39 and 41 remain at an acute angle with respect to the drag link 44. Thus, the scissor arms 34, 35 do not sufficiently close and do not adequately clamp a desired bowling pin A located therebetween (FIG. 12).

With the armature 88 in a retracted position, rotation of the operating arm 45 causes, via the drag link 44, the toggle links 39 and 41 and the mounting portions **34*b* and 35*b*, the slide member 80 to pivot about the pivot bore 81 thereby causing the stop collar 97 to slide along slot 75 from adjacent the first end 76 to adjacent the second end 77 of the slot 75. Once the stop collar 97 abuts against second end 77, this abutment prevents further pivoting movement of the slide member 80 and the pivot axis 38 and, thereafter, further rotational movement of the operating arm 45 increases the angle between the drag link 44 and the toggle links 39 and 41 to commence closing of the arms 34, 35. However, as can be seen in FIG. 12, with the slide member 80 pivoted to its second position, the toggle links 39 and 41 do not become substantially perpendicular with the drag link 44 once the operating arm 45 has completed its stroke and thus arms 34 and 35 are not brought sufficiently close to one another to adequately clamp and pickup a desired bowling pin A. Accordingly, the bowling pin A located between the arms 34, 35 is not clamped and raised and is thus swept away by the sweeper S, during its sweeping motion, controlled by a known sweeper controller C (FIG. 12**).

The return pivoting motion of the operating arm 45 pivots the slide member 80, about pivot bore 81, back from its second position into its first position where the stop collar 97 again abuts against the first end 76 of the slot 75. The armature 88 is de-energized and thus engages the cavity 74 once the slide member 80 returns to its first position. The movable pivot mechanism 89 is thus ready for a further pin resetting cycle.

It is to be appreciated that the solenoid 87 only has to be energized for a short duration of time, e.g. for a sufficient time to allow the slide member 80 to commence its pivoting movement. Once the abutment surface 82 passes over the cavity 74, the solenoid 87 can be de-energized and the armature 88 is prevented from engaging with the cavity 74 as the top surface of the slide member is in an obstructing position. When the slide member 80 again returns to its first position, the armature 88 can then engage the cavity 74 and thus prevent undesired pivoting movement of the slide member 80.

In a preferred form of the invention, the operating arms 45 for the 3, 5, 8, 9 and 10 pin openings have a spring S (FIG. 15) biasing the associated toggle member 44 toward the operating arm 45. This spring biasing motion induces the first portion **34*b* of the arm 34 to pivot counter-clockwise about the pivot axis 38 and move the arm away from an adjacent scissor mechanism prior to or simultaneously with commencement of the sliding movement of the stop collet 97 in the slot 75. Thus, the spring S assures proper closing motion of the scissor assembly without hinderance from any adjacent equipment. When the spring S is under tension, it attempts to bias the toggle 44 counter-clockwise about pivot 44*b* which is fast with the toggle 44. Accordingly, once the operating arm 45 commences its clockwise pivoting motion about pivot point 46, the drag link 44 is instantaneously pivoted counterclockwise about pivot 44*b* for a small distance until the arm 34 clears in the adjacent equipment. Thereafter, the spring S is relaxed and the toggle members 39, 41 and the drag linkage 44** operate as previously discussed.

Figure 2:
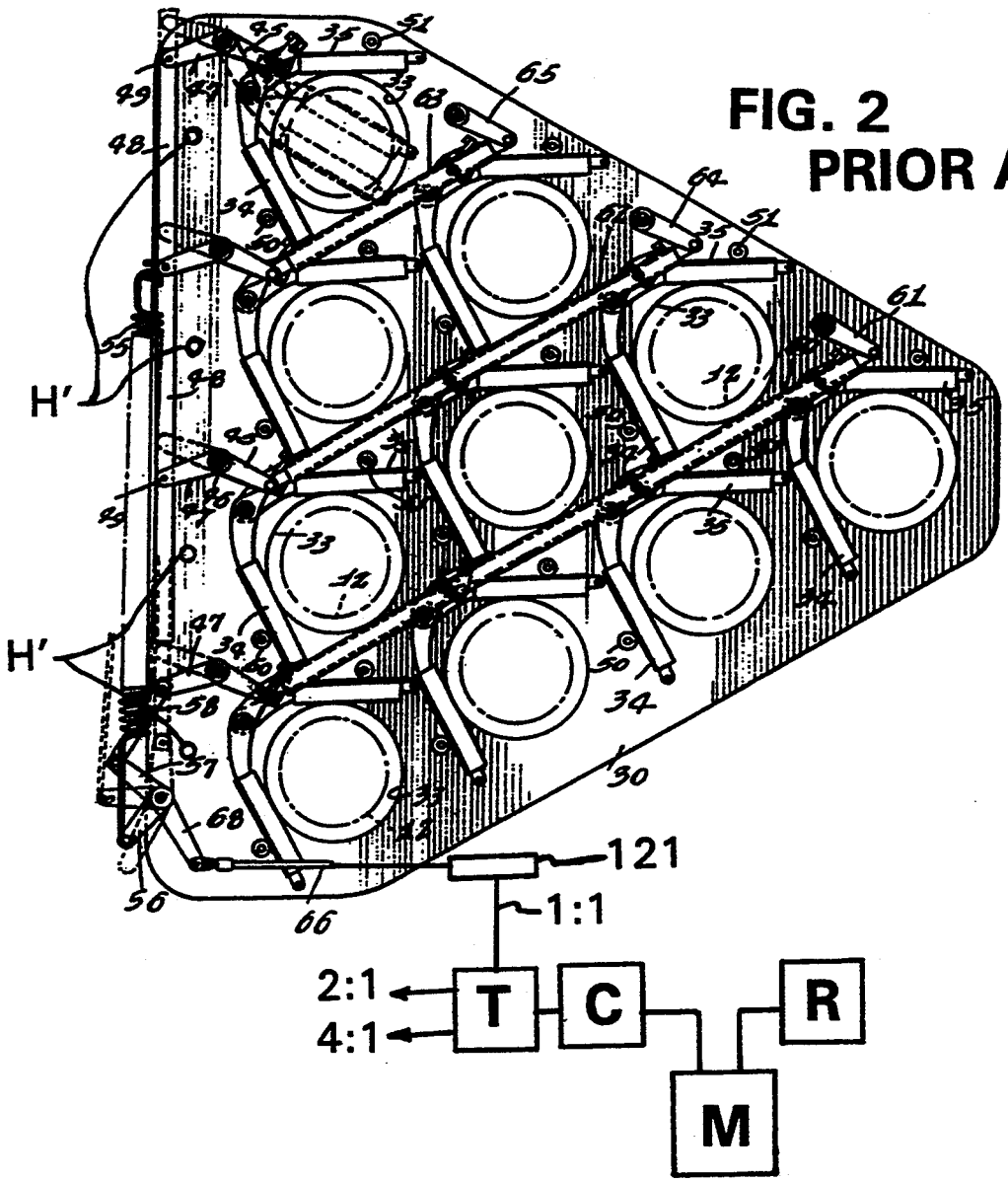
FIG. 2 PRIOR ART
FIG. 2 is a horizontal section taken generally along the line 2—2 in FIG. 1.
Figure 3:
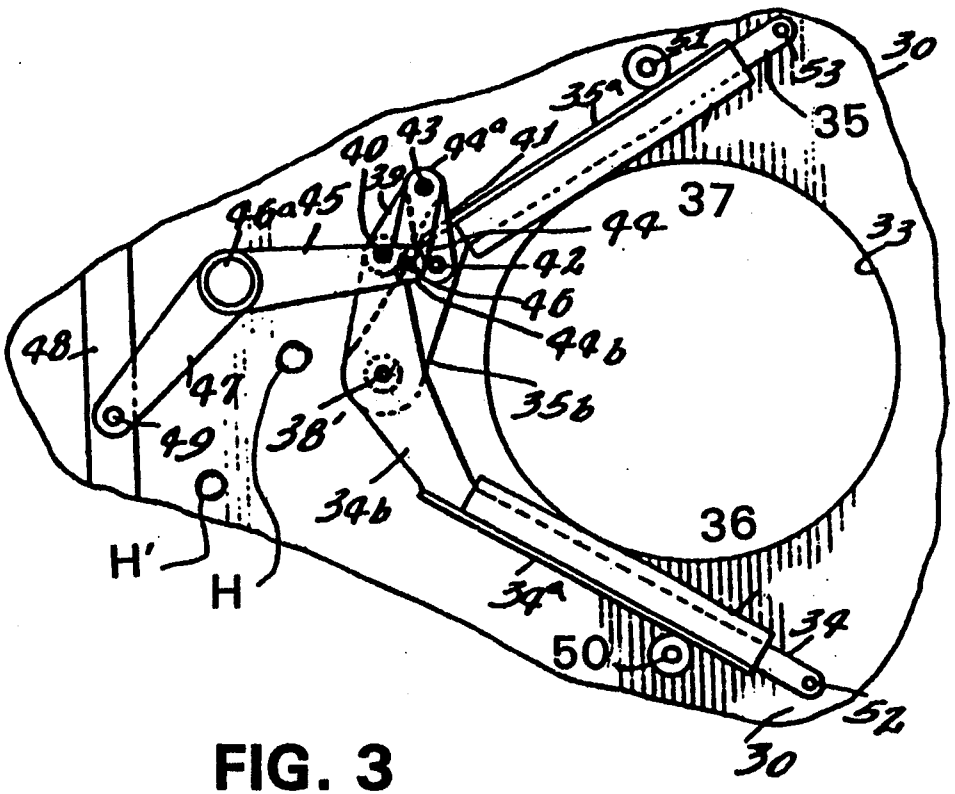
FIG. 3 PRIOR ART
FIG. 3 is a diagrammatic plan view of the pin pickup mechanism for either the number 7 or number 10 pin as shown in FIG. 2.

As can be seen in FIG. 2, a motor M provides an output drive which is divided into two power branches. The first power branch from the motor M drives the remaining components R of that bowling alley bed while the second power branch is inputted into a clutch C connected to a transmission T which typically has at least three outputs, e.g. the input to output ratios are 1:1, 2:1 and 1:4, respectively. For further detailed description concerning the know prior art arrangement, see U.S. Pat. No. 2,949,300 which teaching is incorporated by reference in this application.

Figure 13:
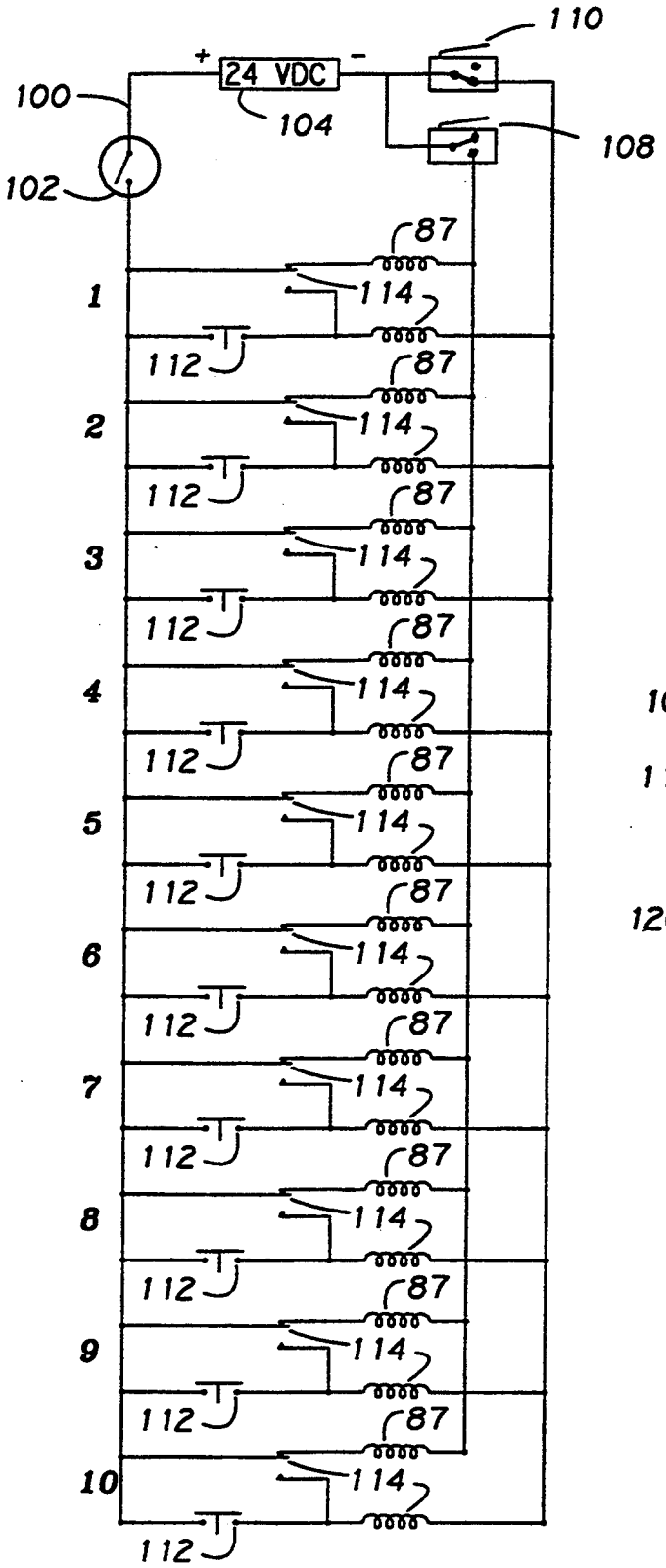
FIG. 13 is a diagrammatic wiring diagram, of one embodiment, for remote operation of ten installed pin pickup mechanisms.

Referring now to FIGS. 2 and 13, one form of an electrical control system for operation of ten movable pivot mechanisms 89, according to the present invention, from the bowling end of the bowling alley bed will now be provided. A control system 100 is provided with an on/off switch 102 which is typically activated by a key. The switch 102, when rotated to an "on" position, supplies 24 volts DC power from a battery or other suitable power source 104 to the control system 100. All ten solenoids 87, for operating the associated ten scissor mechanisms of the scissors deck, are wired in parallel. Accordingly, operation of only the one solenoid will be discussed in detail, with operation of the remaining nine solenoids being identical thereto.

The first solenoid 87 receives power from the 24 volts DC supply via a normally closed relay 114'. The solenoid 87 is also connected to ground via a normally opened micro-switch 108 arranged in series with a normally closed micro-switch 110. A momentary activation switch 112 is provided for activating a relay 114 and this switch also receives power from the 24 volt DC supply. When the relay 114 is activated, via the associated activation switch 112, the contact opens and maintains the normally closed contact 114' in an "open" position until the normally closed micro-switch 110 is opened, thereby causing a power interruption which resets the control system 100. Preferably, the ten activation switches 112 will be numbered 1–10 and arranged on a face plate of the control system 100 in the typical bowling pyramid formation.

Figure 14:
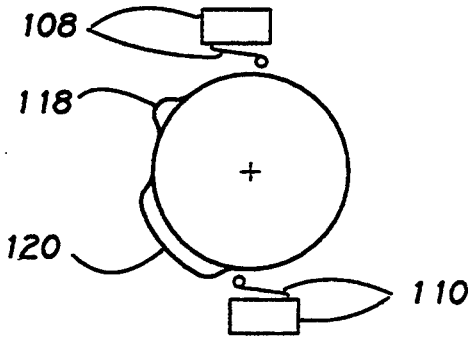
FIG. 14 is a diagrammatic view of the engagement between the cams and the micro-switches.

A pair of cams 118 and 120, for engaging and operating the exterior switches 108' and 110' of the micro-switches 108 and 110, are provided at a desired location along the 1:1 output shaft, e.g. a disc 121 supported by the shaft that rotates one complete rotation during each complete pin resetting cycle (FIG. 14). As the output shaft begins to rotate, during a pin resetting cycle, the exterior switch 108' of the second micro-switch 108 is mounted to engage the second (elongate) cam 120, once the 1:1 output shaft has rotated approximately 60°, and maintain that engagement with the exterior switch 108' for approximately the next 60°-120° or so of rotation. This engagement between the second cam 120 and the exterior-switch 108' closes the associated normally opened contact and thereby energizes all of the selected solenoid(s) 87. After the 1:1 shaft has rotated at least about 120°, the second cam 120 disengages from the exterior switch 108' of the second micro-switch 108 and this disengagement allows the normally opened contact to again "open".

Once the 1:1 shaft has rotated approximately 270°, the exterior switch 110' of the first micro-switch 110 is located to contact a first cam 118 and briefly open, e.g. for only a few seconds, the normally closed contact which resets the control system.

A bowler, desiring bowling practice, selects the pin or pins which the bowler wishes to remain on the bowling alley bed, once resetting of the pins has occurred, by depressing desired one(s) of the associated activation switch(es) 112. When an activation switch 112 is selected (briefly depressed), this opens the normally closed contact of the relay 114 associated with that selected (depressed) activation switch 112 and thereby prevents electrical power from communicating with the associated selected solenoid 87 during the resetting cycle. Accordingly, sliding movement of the movable pivot mechanism(s) 89 associated with each selected solenoid(s) 87 does not occur, i.e. the pivot axis 38 does not move and thus operates as a fixed pivot in which the scissor arms 34, 35 sufficiently clamp and raise a associated bowling pin A located therebetween.

If an activation switch 112 is not selected (depressed), the normally closed contact 114' of the relay 114 associated with that non-selected activation switch 112 remains closed and thereby provides electrical power to the associated non-selected solenoid 87 during the resetting cycle. Accordingly, sliding movement of the movable pivot mechanism(s) 89 associated with each non-selected solenoid(s) 87 occurs, i.e. the associated armature(s) 88 are retracted and the pivot axis 38 moves to its second position where the scissor arms 34, 35 do not sufficiently close and a bowling pin A located therebetween is not raised during the upward motion of the scissor deck 30, i.e. the bowling pin remains on the bowling alley bed where it is swept away by the sweeper during its sweeping motion.

When the scissors deck 30 is again moved toward the bowling alley bed, the bowling pin(s) previously clamped by the scissor arms 34, 35 are released on the bowling bed surface thereby leaving the desired pin combination for bowling practice.

It is to be appreciated that the electrical schematic shown in FIG. 13 is merely one example for achieving activation of selected ones of the ten solenoids. Various modifications and refinements to the wiring diagram will be readily apparent to one skilled in this art and such modifications and refinements are considered to be within the spirit and scope of the present invention. For example, a computer can be integrated with control system for automatically controlling the activation switches 112 to provide a random combination of pins to be left on the bowling surface and/or automatically providing a series of difficult pin combinations to facilitate bowling practice. In addition, the computer could be provided with sensors to determine if the bowler successfully knocks down all of the pin(s) and, if this did not occur, to repeat the previously selected pin combination.

It is to be appreciated that although the movable pivot mechanism is shown as comprising a plurality of elements, and it could conceivable comprise ten solenoids mounted directly on the scissors deck, each solenoid having a T-nut fastened to the remote end of the armature with energization and de-energization of the solenoid moving the armature to and fro and thereby providing the first and second positions of the pivot.

I claim:

1. In a pin setting apparatus comprising a scissors deck having ten pin openings provided therein with a pair of scissor arms being located adjacent each of the ten pin openings, each said pair of scissor arms having a common pivot located adjacent one of the ten pin openings and said scissor arms being movable over at least a portion of a said adjacent pin opening, a sweeper for sweeping the bowling surface, and a mechanism for controlling various components of said pin setting apparatus, including at least said scissors deck, said scissor arms and said sweeper for resetting bowling pins, the improvement wherein at least one of said pair of scissor arms has its common pivot supported by said scissors deck so as to be movable relative thereto whereby, during operation of said mechanism for controlling said pin setting apparatus, said common pivot is movable from a first normal operational position, in which said scissor arms are positioned to clamp and raise a said pin located therebetween during a resetting cycle, to a second position in which said mechanism for controlling said pin setting apparatus insufficiently activates said scissor arms so that said scissor arms insufficiently close during the resetting cycle whereby a said pin located therebetween is not clamped and raised by said scissor arms and is swept away by said sweeper, and a selectively mechanism, interacting with said movable common pivot of said at least one of said pair of scissor arms, for one of selectively allowing and preventing said common pivot from moving to the second position during a desired resetting cycle.

2. The pin setting apparatus according to claim 1, wherein said mechanism for controlling said pin setting apparatus to reset the bowling pins, comprises a pivotable operational arm having a first end of a drag link pivotally supported adjacent one end thereof, a second end of said drag link is connected to each scissor arm via two toggle links, and a spring interconnects the first end of said drag link with the end of said operational arm pivotably supporting said drag link for biasing said drag link toward said operational arm during a said resetting cycle of the pin setting apparatus.

3. The pin setting apparatus according to claim 1, wherein all ten said pair of scissor arms have a common pivot which is movable from a first position, in which said scissor arms are positioned to clamp and raise a said pin located therebetween during a resetting cycle, to a second position in which said mechanism for controlling said pin setting apparatus insufficiently activates said scissor arms so that said scissor arms insufficiently close during the resetting cycle whereby a said pin located therebetween is not clamped and raised by said scissor arms and is swept away by said sweeper.

4. The pin setting apparatus according to claim 3, wherein said pin setting apparatus includes ten selective mechanisms for one of selectively allowing and preventing each said ten common pivots from moving and each said selective mechanism includes a solenoid having an armature, and one of said selective mechanisms is associated with said common pivot of each of said ten pair said scissor arms, and each of said ten solenoids is electrically connected to a control system for selectively activating and deactivating each said solenoid for selectively leaving a desired pin combination on the bowling surface after a said resetting cycle.

5. In a pin setting apparatus comprising a scissors deck having ten pin openings provided therein with a pair of scissor arms being located adjacent each of the ten pin openings, each said pair of scissor arms having a common pivot located adjacent one of the ten pin openings and said scissor arms being movable over at least a portion of a said adjacent pin opening, a sweeper for sweeping the bowling surface, and a mechanism for controlling various components of said pin setting apparatus, including at least said scissors deck, said scissor arms and said sweeper for resetting bowling pins;

the improvement wherein at least one of said pair of scissor arms has its common pivot supported by a movable mechanism connected to said scissor deck so that during operation of said mechanism for controlling said pin setting apparatus, said common pivot is movable from a first normal operational position, in which said scissor arms are positioned to clamp and raise a said pin located therebetween during a resetting cycle, to a second position in which said mechanism for controlling said pin setting apparatus insufficiently activates said scissor arms so that said scissor arms insufficiently close during the resetting cycle whereby a said pin located therebetween is not clamped and raised by said scissor arms and is swept away by said sweeper, and a selective mechanism, interacting with said movable common pivot of said at least one of said pair of scissor arms, for one of selectively allowing and preventing said common pivot from moving to the second position during a desired resetting cycle; and said movable mechanism comprises an intermediate member which supports said common pivot of said scissor arms and said intermediate member is movable relative to said scissors deck.

6. The pin setting apparatus according to claim 5, wherein a base member is securely fastened to said scissors deck and said intermediate member is pivotally supported by said base member.

7. The pin setting apparatus according to claim 6, wherein said movable mechanism further comprises a top member, and said intermediate member is located between said top member and said base member.

8. The pin setting apparatus according to claim 3, wherein said selective mechanism for one of allowing and preventing said common pivot from pivoting is a solenoid having an armature supported by said top member, and said armature, when in a first extended position, engages with said intermediate member and prevents pivoting movement thereof relative to said top member and said base member and, when said armature is in a second retracted position, said intermediate member is free to pivot relative to said top member and said base member.

9. The pin setting apparatus according to claim 8, wherein said base member has a cavity located to receive said armature of said solenoid, when said armature is in the first extended position, and said intermediate member has an abutment surface which abuts against an exterior surface of said armature, when extended, to prevent pivoting movement of said intermediate member relative to said top member and said base member.

10. The pin setting apparatus according to claim 9, wherein said intermediate member has a bearing which facilitates pivoting movement of said intermediate member relative to at least said base member.

11. The pin setting apparatus according to claim 8, wherein said apparatus further includes a control system electrically connected to said solenoid for controlling actuation thereof, and, when said control system activates said solenoid, said common pivot moves, during a said resetting cycle, to the second position in which said scissor arms insufficiently close.

12. The pin setting apparatus according to claim 11, wherein said control system includes means for actuating said solenoid for a desired time duration during a said resetting cycle of the pin setting apparatus.

13. The pin setting apparatus according to claim 5, wherein said mechanism for controlling said pin setting apparatus to reset the bowling pins, comprises a pivotable operational arm having a first end of a drag link pivotally supported adjacent one end thereof, a second end of said drag link is connected to each scissor arm via two toggle links, and a spring interconnects the first end of said drag link with the end of said operational arm pivotably supporting said drag link for biasing said drag link toward said operational arm during a said resetting cycle of the pin setting apparatus.

14. The pin setting apparatus comprising a scissors deck having ten pin openings provided therein with a pair of scissor arms being located adjacent each of the ten pin openings, each said pair of scissor arms having a pivot axis located adjacent one of the ten pin openings and said scissor arms being movable over at least a portion of a said adjacent pin opening, a sweeper for sweeping the bowling surface, and a mechanism for controlling said scissors deck, said scissor arms and said sweeper for resetting bowling pins, according to claim 5, wherein all ten said pair of scissor arms have a common pivot which is movable from a first position, in which said scissor arms are positioned to clamp and raise a said pin located therebetween during a resetting cycle, to a second position in which said mechanism for controlling said pin setting apparatus insufficiently activates said scissor arms so that said scissor arms insufficiently close during the resetting cycle whereby a said pin located therebetween is not clamped and raised by said scissor arms and is swept away by said sweeper.

15. The pin setting apparatus according to claim 14, wherein said pin setting apparatus includes ten selective mechanisms for one of selectively allowing and preventing each said ten common pivots from moving and each said selective mechanism includes a solenoid having an armature, and one of said selective mechanisms is associated with said common pivot of each of said ten pair said scissor arms, and each of said ten solenoids is electrically connected to a control system for selectively activating and deactivating each said solenoid for selectively leaving a desired pin combination on the bowling surface after a said resetting cycle.

16. A method of modifying a pin setting apparatus comprising a scissors deck having ten pin openings provided therein with a pair of scissor arms being located adjacent each of the ten pin openings, each said pair of scissor arms having a fixed common pivot located adjacent one of the ten pin openings and said scissor arms being movable, about said fix common pivot, over at least a portion of a said adjacent pin opening, a sweeper for sweeping the bowling surface, and a mechanism for controlling various components of said pin setting apparatus, including at least said scissors deck, said scissor arms and said sweeper for resetting bowling pins;

said method comprising the steps of:

removing said fixed common pivot for each of said ten pairs of scissor arms;

replacing each said fixed common pivot with a common pivot supported movably relative to said scissor deck;

connecting said movable common pivot to said mechanism for controlling said pin setting apparatus so that said common pivot is movable, via said mechanism for controlling said pin setting apparatus, from a first position in which said scissor arms are positioned to clamp and raise a said pin located therebetween during a resetting cycle, and a second position in which said mechanism for controlling said pin setting apparatus insufficiently activates said scissor arms so that said scissor arms insufficiently close during the resetting cycle whereby a said pin located therebetween is not clamped and raised by said scissor arms; and selectively preventing said common pivot from moving to said second position during a desired resetting cycle so that a desired pin is not clamped and raised by its associated scissor arms.

* * * * *